US005257580A

United States Patent [19]

Theurer et al.

[11] Patent Number: 5,257,580

[45] Date of Patent: Nov. 2, 1993

[54] ARRANGEMENT AND METHOD FOR PRODUCING A PROTECTIVE LAYER ON THE SUBGRADE OF A TRACK

[75] Inventors: Josef Theurer, Vienna; Manfred Brunninger, Altenberg, both of Austria

[73] Assignee: Franz Plasser Bahnbaumaschinen-Industriegesellschaft m.b.H., Vienna, Austria

[21] Appl. No.: 970,142

[22] Filed: Nov. 2, 1992

[30] Foreign Application Priority Data

Nov. 13, 1991 [AT] Austria ..... 2248/91

[51] Int. Cl.[5] ..... E01B 27/06

[52] U.S. Cl. ..... 104/2; 104/7.1; 37/104; 171/16

[58] Field of Search ..... 104/2, 7.1, 7.3; 37/104; 171/16

[56] References Cited

U.S. PATENT DOCUMENTS

| | | | |
|---|---|---|---|
| 3,872,929 | 3/1975 | Teurer et al. | 104/2 X |
| 4,266,615 | 5/1981 | Theurer et al. | 104/2 X |
| 4,357,874 | 11/1982 | Theurer | 104/2 |
| 4,400,897 | 8/1983 | Scheuchzer et al. | 37/104 |
| 4,479,439 | 10/1984 | Theurer et al. | 104/2 X |
| 4,576,538 | 3/1986 | Theurer et al. | 104/2 X |
| 4,703,568 | 11/1987 | Theurer et al. | 104/2 X |
| 5,172,635 | 12/1992 | Theurer | 104/2 |

FOREIGN PATENT DOCUMENTS

| | | |
|---|---|---|
| 0302225 | 2/1989 | European Pat. Off. . |
| 1984143 | 4/1968 | Fed. Rep. of Germany . |
| 3528152 | 2/1986 | Fed. Rep. of Germany . |
| 159186 | 5/1981 | German Democratic Rep. . |

OTHER PUBLICATIONS

International Eisenbahnveband, of Jan. 1, 1990, UIC-Kodex 722 E, p. 11.

*Primary Examiner*—Robert J. Oberleitner
*Assistant Examiner*—S. Joseph Morano
*Attorney, Agent, or Firm*—Collard & Roe

[57] ABSTRACT

A mobile track working machine arrangement comprises two consecutively arranged, independent track working vehicles, each track working vehicle comprising an elongated two-part machine frame, the two parts of the machine frame being linked by a pivot for pivoting of one part in relation to the other part about a horizontal axis extending perpendicularly to the track, and undercarriages supporting the machine frame on the track. A ballast excavating device is vertically adjustably mounted on the machine frame of a first track working vehicle for excavating the ballast supporting the track whereby the subgrade is exposed, and a conveyor arrangement is mounted on the machine frame of the first track working vehicle for removing the excavated ballast. A device for planing and compacting a protective layer of sand on the subgrade is mounted on the machine frame of the second track working vehicles. A track lifting device is mounted on each machine frame, each track lifting device comprising lifting rollers rollingly engaging the track rails in permanent frictional contact therewith, and a device for sweeping sand from the ties into adjacent cribs is mounted on the machine frame of at least one of the vehicles.

10 Claims, 2 Drawing Sheets

ARRANGEMENT AND METHOD FOR PRODUCING A PROTECTIVE LAYER ON THE SUBGRADE OF A TRACK

BACKGROUND OF THE INVENTION

1. Field of the Invention

The present invention relates to a mobile track working machine arrangement mounted on a track for movement in an operating direction, the track comprising two rails fastened to ties supported on a subgrade by a bed of ballast. The machine arrangement comprises two consecutively arranged, independent track working vehicles, each track working vehicle comprising an elongated machine frame and undercarriages supporting the machine frame on the track. A ballast excavating device is vertically adjustably mounted on the machine frame of a first one of the track working vehicles for excavating the ballast supporting the track whereby the subgrade is exposed, and a conveyor arrangement is mounted on the machine frame of the first track working vehicle for removing the excavated ballast. A device for planing and compacting a protective layer of sand on the exposed subgrade is mounted on the machine frame of a second one of the track working vehicles, and a track lifting device is mounted on each machine frame.

This invention also relates to a method for rehabilitating a ballast bed supporting a track on a subgrade with a track working machine arrangement advancing continuously along the track, which comprises the steps of lifting the track and continuously excavating dirty ballast from under the lifted track to expose the subgrade, discharging sand through the lifted track to lay a protective layer of sand on the subgrade, and planing and condensing the protective layer of sand.

2. Description of the Prior Art

U.S. Pat. No. 4,479,439 discloses a mobile track working machine arrangement for rehabilitating a ballast bed by laying a protective layer of sand between the exposed subgrade and the ballast as the track working machine arrangement continuously advances along the track in an operating direction. This arrangement comprises a vehicle comprising an elongated machine frame supported on the track by undercarriages, and a ballast excavating device is vertically adjustably mounted on the machine frame between two of the undercarriages. A conveyor arrangement is mounted on the machine frame for removing the excavated ballast. Another conveyor arrangement is arranged on the machine frame behind the ballast excavating device in the operating direction for conveying sand and has a discharge end immediately rearwardly of the ballast excavating device for laying a protective layer of sand on the subgrade exposed by the ballast excavating device. A device for planing and compacting the protective layer of sand is mounted on the machine frame immediately rearwardly of the sand discharge end of the other conveyor arrangement. Still another conveyor arrangement is arranged on the machine frame for conveying clean ballast and has a discharge end behind the sand layer planing and compacting device for discharging the clean ballast on the planed and compacted protective sand layer. A track lifting device is mounted on the machine frame centrally between the two undercarriages for lifting the track while the dirty ballast is excavated, the protective sand layer is laid on the exposed subgrade and is planed and compacted, and the clean ballast is discharged on the planed and compacted sand layer.

U.S. Pat. No. 4,357,874 discloses another mobile track working machine arrangement for such a rehabilitation of a track bed by interposing a protective layer of sand between the subgrade and the ballast in a multistage operation. This arrangement comprises two consecutively arranged, independent vehicles and each vehicle has an elongated, bridge-like machine frame whose ends are supported on the track by on-track undercarriages. In addition, each machine frame has a vertically adjustable off-track undercarriage adjacent one of the on-track undercarriages. The track bed rehabilitation is initiated by detaching an assembled track section from the track under a first one of the vehicles and lifting the assembled track section off the underlying dirty ballast to create a trackless renewal section. The first vehicle is then advanced to an adjoining track section by suitable operation of the on- and off-track undercarriages supporting the front end of the bridge-like machine frame on the adjoining track section while its rear end is supported on the trackless renewal section by the lowered off-track undercarriage and then by the adjacent on-track undercarriage on the adjoining track section as the off-track undercarriage is retracted. At the same time, the second vehicle is moved over the trackless renewal section in a like manner and a ballast excavating device on the second vehicle excavates the dirty ballast to expose the subgrade. The second vehicle is then moved back again and the first vehicle is returned to the trackless renewal section to lay a protective layer of sand on the exposed subgrade and to lay a ballast bed over the sand layer before the assembled track section is lowered onto the ballast bed. This arrangement is useful primarily for the rehabilitation of short track sections UIC-Kodex 722 E of the Internationaler Eisenbahnverband (International Railroad Association), of Jan. 1, 1990, also describes a method for rehabilitating a ballast bed. In this method, the dirty ballast is removed by a ballast cleaning machine to expose the subgrade. The excavated ballast is partially deposited on the track shoulder or is loaded onto box cars. The exposed subgrade is then planed and a textile layer may be laid on the planed subgrade. Subsequently, a mixture of gravel and sand is unloaded from box cars and distributed by a ballast planing machine until it has reached the desired depth. Thereupon, a track leveling, lining and tamping machine is used to tamp the gravel-sand mixture under the track ties, whereupon ballast is unloaded from box cars, the track is raised and the track leveling, lining and tamping machine is used to level and line the track and to tamp the ballast under the ties to fix the track in its leveled and lined position. This method requires a considerable number of machines and is, therefore, expensive.

German patent application No. 3,528,152, published Feb. 20, 1986, discloses a machine for rehabilitating a track bed, which comprises a bridge-like machine frame with track lifting devices for lifting the track while an undercutter excavates ballast from under the lifted track to expose the subgrade, a protective layer of gravel or the like is laid on the exposed subgrade, ballast is laid over the protective layer, the ballast is planed and compacted, any gravel and/or ballast on the track ties is swept into adjacent cribs by a rotary brush, and the track is lowered onto the planed and compacted ballast. This patent application is concerned primarily with the mounting of the vertically adjustable and laterally displaceable operating devices of the machine.

Patent No. 159,186 of the German Democratic Republic discloses a ballast cleaning machine carrying a ballast excavating device for excavating ballast under a track to expose the subgrade. A chute extending over the width of the track is mounted on the machine frame and has a front opening receiving sand and a rear opening discharging the sand over the exposed subgrade. A rotary brush is mounted at the front opening of the chute to convey the sand into the opening.

SUMMARY OF THE INVENTION

It is the primary object of the invention to improve a mobile track working machine arrangement of the first-described type to make it more efficient in operation and to simplify the material conveyance.

According to one aspect of the present invention, the above and other objects are accomplished with a mobile track working machine arrangement comprising two consecutively arranged, independent track working vehicles, each track working vehicle comprising an elongated two-part machine frame, the two parts of the machine frame being linked by a pivot for pivoting of one part in relation to the other part about a horizontal axis extending perpendicularly to the track, and undercarriages supporting the machine frame on the track. A ballast excavating device is vertically adjustably mounted on the machine frame of a first one of the track working vehicles for excavating the ballast supporting the track whereby the subgrade is exposed, and a conveyor arrangement is mounted on the machine frame of the first track working vehicle for removing the excavated ballast. A device for planing and compacting a protective layer of sand on the exposed subgrade is mounted on the machine frame of a second one of the track working vehicles. A track lifting device comprising lifting rollers rollingly engaging the track rails in permanent frictional contact therewith is mounted on each machine frame, and a device for sweeping sand from the ties into adjacent cribs is mounted on the machine frame of at least one of the vehicles.

According to another aspect of this invention, there is provided a method for rehabilitating a ballast bed supporting a track on a subgrade with a track working machine arrangement advancing continuously along the track, which method comprises the steps of lifting the track and continuously excavating dirty ballast from under the lifted track to expose the subgrade, discharging sand through the lifted track to lay a protective layer of sand on the subgrade, lowering the track onto the protective layer of sand, and lifting the track again and continuously planing and condensing the protective layer of sand.

Such a ballast bed rehabilitation arrangement and method produces a highly efficient, continuous operation. The two-part machine frames whose two machine frame parts are pivotally linked permit a lifting of the track by track lifting devices with rail-engaging lifting rollers over a sufficiently long track section to enable the dirty and encrusted ballast to be completely excavated to expose the subgrade without subjecting the track rails to undue bending stresses. Furthermore, by using two consecutively arranged, independent track working vehicles, which can be simultaneously operated, the ballast and sand conveyance is greatly facilitated because it is divided into two spatially distanced track renewal sections so that the respective material conveyances do not interfere with each other. This has the additional advantage that the operating devices on the two consecutively arranged vehicles may be operated independently of each other so that each device may be used with optimal efficiency and without interfering with each other. In view of the improved division of the material conveyances and starting at one of the four machine frame ends of the track working machine arrangement, the material removal and delivery may be limited to a single type of material, i.e. dirty excavated ballast to be removed and clean ballast or sand to be delivered. This makes it possible to use economically and operationally effective box cars with bottom conveyor bands for storing and conveying bulk material, such as ballast and sand, in the track working machine arrangement. Such box cars are disclosed, for example, in U.S. Pat. No. 4,576,538.

In the ballast bed rehabilitation method of the invention, the large material movements can be better divided so that a respective box car adjoining one of the four machine frame ends of the track working machine arrangement may be filled with one of the materials, i.e. excavated ballast, sand or clean ballast. By lowering the track onto the protective layer of sand, the weight of the track will provide some compaction of the sand layer before it is finally planed and compacted. There is more room for the operating devices, such as a rotary brush for sweeping sand off the ties into adjacent cribs before the sand layer is planed and compacted.

The ballast excavating device and the sweeping device are preferably each mounted between two of said undercarriages, the undercarriages being mounted on the elongated machine frames for displacement in the direction of elongation of the machine frames, and drives are connected to the undercarriages for the displacement thereof. This enables a relatively simply constructed machine frame to have a variable wheel base so that the length of the track section under the machine frame may be readily and rapidly extended before the operation begins so that this track section may be lifted without being subjected to the weight of the machine frame supported by the undercarriages. If one of the displaceable undercarriages supporting the machine frames on the track immediately precedes the pivot in the operating direction for support of one of the machine frame parts, and another undercarriage is non-displaceably connected to the one machine frame part for support of the one machine frame part remote from the pivot, the pivot may be relocated outside the track section delimited by the two undercarriages. In this manner, the length of the other machine frame part respectively carrying the ballast excavating device and the planing and compacting device can be reduced to improve the operation in track curves.

According to the preferred embodiment, two track lifting devices are mounted on each machine frame, the ballast excavating device and the sweeping device, respectively, being arranged on a respective one of the machine frames between the two track lifting devices. This produces an improved track lift with a reduced tensioning of the track rails.

According to another preferred embodiment, the sweeping device is vertically adjustably mounted on the machine frame and comprises a brush rotatable by a drive about an axis extending transversely to the machine frame elongation and parallel to the plane of the track, and a drive connects the sweeping device to the machine frame for vertically adjusting the sweeping device. Preferably, the sweeping device is mounted on the machine frame of the second vehicle immediately preceding the sand planing and compacting device, in the operating direction. In this way, any sand deposited on the ties when the sand is deposited on the exposed subgrade through the track can be swept off the ties so that the entire volume of sand lies on the subgrade when the sand layer is planed and compacted. This will also improve the quality of the ballast bed rehabilitation because it clearly separates the planed and compacted protective sand layer from the ballast deposited subsequently on this sand layer.

Preferably, the machine frame of the first vehicle defines an input opening for discharging sand on the exposed subgrade, the input opening immediately trailing the ballast excavating device, in the operating direction, and the machine frame of the second vehicle defines an input opening for discharging ballast on the planed and compacted sand, the input opening trailing the sand planing and compacting device, in the operating direction. Such openings may be defined simply by chutes for directly discharging sand and clean ballast, respectively, delivered thereto from an adjoining box car storing the sand or clean ballast. This material discharge is effected while the machine frames are lifted for the ballast excavation and the sand planing and compacting, respectively.

Advantageously, the conveyor arrangement comprises an elongated conveyor band extending forwardly from the ballast excavating device in the operating direction, the elongated conveyor band having an input end arranged to receive the excavated ballast from the ballast excavating device and a discharge end, a ballast storage silo arranged to receive the excavated ballast from the discharge end of the elongated conveyor band, and another conveyor band arranged at the bottom of the ballast storage silo for removing the stored ballast therefrom. This assures a flawless removal of the excavated dirty ballast if an adjoining box car for storing the excavated ballast is filled and/or if there is any interruption of the conveyance because the ballast storage silo will provide an intermediate storage until the adjoining box car has been emptied and/or the interrupted conveyance has been restored.

BRIEF DESCRIPTION OF THE DRAWING

The above and other objects, advantages and features of the present invention will be described hereinafter in detail in connection with two now preferred embodiments thereof, taken in conjunction with the accompanying schematic drawing wherein.

DETAILED DESCRIPTION OF THE PREFERRED EMBODIMENTS

Figure 1:
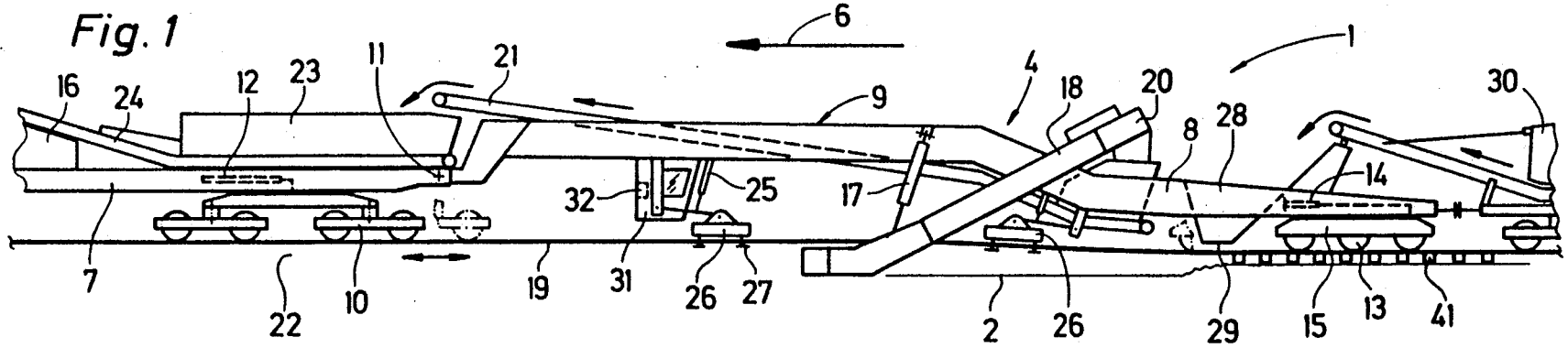
FIGS. 1 and 2 show side elevational views of the two consecutively arranged, independent track working vehicles of one preferred embodiment of the track working machine arrangement.
Figure 2:
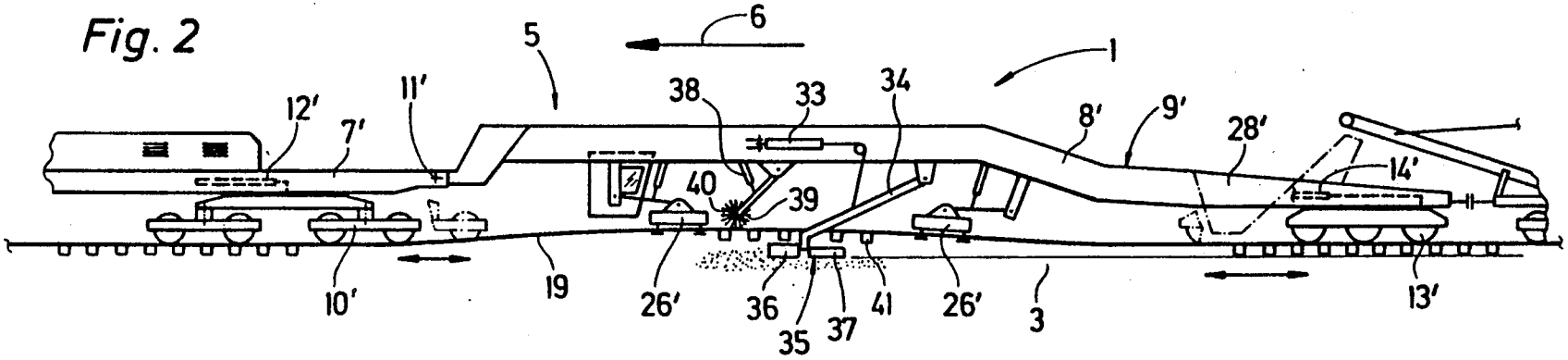

Referring now to the drawing and first to FIGS. 1 and 2, there is shown mobile track working machine arrangement 1 mounted on a track 19 for movement in an operating direction indicated by arrows 6. The track comprises two rails fastened to ties 41 supported on subgrade 2 by a bed of ballast 22, and the machine arrangement is designed to interpose protective layer 3 of sand between the subgrade and the ballast bed. The machine arrangement comprises two consecutively arranged, independent track working vehicles 4 and 5. Each track working vehicle comprises elongated two-part machine frame 9, 9', the two parts 7, 8 and 7', 8' of the machine frame being linked by pivot 11, 11' for pivoting of one part 8, 8' in relation to the other part 7, 7' about a horizontal axis extending perpendicularly to track 19. Undercarriages 10, 13 and 10' 13' support the machine frame 9 and 9' on the track. Drive 15 for propelling track working vehicle 4 in the operating direction is mounted on undercarriage 13 and a like drive on undercarriage 13' may propel vehicle 5. Machine frame 9 carries a central energy source 16 for all the operating drives carried by vehicle 4 and a like energy source is carried by machine frame 9' of vehicle 5.

The undercarriages are mounted on elongated machine frames 9 and 9' for displacement in the direction of elongation of the machine frames and drives 12, 12' and 14, 14' are connected to the undercarriages for the displacement thereof. Displaceable undercarriages 10, 10' supporting the machine frames 9, 9' on track 19 immediately precede pivot 11, 11' in the operating direction for support of machine frame parts 7, 7', and another undercarriage (not shown in fragmentary FIGS. 1 and 2) is non-displaceably connected to the one machine frame part for support of the one machine frame part remote from the pivot.

Rear machine frame part 8 is of bridge-like construction and defines a recessed space in which ballast excavating device 18 is vertically adjustably mounted by drives 17 on machine frame 9 of first track working vehicle 4 for excavating ballast 22 supporting track 19 whereby subgrade 2 is exposed. Such ballast excavating devices are entirely conventional wherefore a description thereof is omitted to avoid prolixity. As is similarly conventional, the dirty excavated ballast is discharged from the ballast excavating device at discharge station 20 at the top of the device onto a conveyor arrangement mounted on machine frame 9 of first track working vehicle 4 for removing the excavated ballast. The illustrated conveyor arrangement comprises elongated conveyor band 21 mounted on rear machine frame part 8 and extending forwardly from ballast excavating device 18 in the operating direction. The elongated conveyor band has an input end arranged to receive the excavated ballast from the ballast excavating device and a discharge end. Ballast storage silo 23 is arranged on forward machine frame part 7 to receive the excavated ballast from the discharge end of elongated conveyor band 21, and another conveyor band 24 is arranged at the bottom of ballast storage silo 23 for removing the stored ballast therefrom. A series of box cars, which may be of a type described in U.S. Pat. No. 4,576,538, precede the (non-illustrated) front end of machine frame part 7 for receiving excavated dirty ballast 22 from conveyor band 14 and for storing this ballast.

Two track lifting devices 26 are mounted on machine frame part 8, each track lifting device comprising two pairs of lifting rollers 27 rollingly engaging the track rails in permanent frictional contact therewith. Drives 25 link the track lifting devices to the machine frame part for vertical and lateral adjustment, of the track lifting device and ballast excavating device 18 is arranged on machine frame part 8 between the two track lifting devices 26. Machine frame part 8 of first vehicle 4 defines input opening 28 leading into chute 29 for discharging sand on exposed subgrade 2, the input opening immediately trailing discharge station 20 of ballast excavating device 18, in the operating direction.

Preferably, a box car 30 of the type fully described and illustrated in U.S. Pat. No. 4,576,538, wherein sand is stored, is coupled to the rear end of vehicle 4 and the sand is delivered through opening 28 into discharge chute 29 by the bottom and transfer conveyors of box car 30. Any number of such box cars may follow vehicle 4 for continuously feeding sand to opening 28. The operating drives on vehicle 4 are controlled from a central control panel 32 in operator's cab 31 located in the recessed portion of bridge-like machine frame part 8.

FIG. 2 illustrates consecutively arranged, second track working vehicle 5 which has the same frame structure as vehicle 4 and the same structural components thereof are designated by the same reference numeral but are primed to avoid redundancy in the description. Device 35 for planing and compacting protective layer 3 of sand on subgrade 2 is mounted on machine frame part 8' of second track working vehicle 5 between the two track lifting devices 26'. The sand planing and compacting device is connected to a lower front end of carrier frame 34 which is vertically adjustably linked to machine frame part 8' and vertically adjustable by drive 33. Sand planing and compacting device 35 is comprised of a curved planing shield 36 extending over the width of protective sand layer 3, followed by a vibratory compacting unit 37. Device 39 for sweeping sand from ties 41 into adjacent cribs is mounted on machine frame part 8' of vehicle 5. The sweeping device is vertically adjustably mounted on the machine frame and comprises a brush rotatable by drive 40 about an axis extending transversely to the elongation of machine frame 9' and parallel to the plane of the track, and drive 38 connects sweeping device 39 to the machine frame for vertically adjusting the sweeping device. The brush has a length corresponding to that of ties 41. Sweeping device 39 is mounted on machine frame 9' of second vehicle 5 immediately preceding sand planing and compacting device 35, in the operating direction.

As shown in FIGS. 1 and 2, ballast excavating device 18 and sweeping device 39 are each mounted between two of the undercarriages 10, 13 and 10', 13' supporting machine frames 9 and 9' on track 19. Machine frame part 8' of second vehicle 5 defines input opening 28' for discharging ballast on the planed and compacted sand, the input opening trailing sand planing and compacting device 35, in the operating direction. Clean ballast is continuously delivered to input opening 28' from box cars following second vehicle 5, in the same manner as described hereinabove in connection with the delivery of sand to input opening 28, and the clean ballast is distributed in the cribs and under the ties of track 19.

The ballast bed supporting track 19 on subgrade 2 is rehabilitated as track working machine arrangement 1 advances continuously along the track in the operating direction indicated by arrows 6. Before the operation begins, the wheelbase of vehicles 4 and 5 used during transit of the vehicles (indicated in phantom lines) is extended into their operating position (shown in full lines) by longitudinally displacing undercarriages 10, 13 and 10', 13' by operation of drives 12, 14 and 12', 14' Initially, track 19 is slightly raised by track lifting devices 26 to enable the excavating chain of ballast excavating device 18 to be inserted under the track. In this operating condition, track working machine arrangement 1 is continuously advanced, track 19 is lifted, as shown in FIG. 1, and dirty ballast 22 is continuously excavated from under the lifted track to expose the subgrade 2. The excavated ballast is continuously discharged at station 20 onto elongated conveyor band 21 which delivers the ballast to storage silo 23 whence it is removed by conveyor band 24. At the same time and while vehicle 4 advances continuously, sand is discharged from chute 29 through the lifted track to lay a protective layer of sand on the subgrade. Some of the sand will fall on ties 41 while most of it will be deposited through the cribs between the ties on subgrade 2. Rear undercarriage 13 will lower track 19 onto the protective layer of sand and press the track down on this sand layer.

Consecutively arranged second vehicle 5 follows first vehicle 4 and intervening sand storage box car or cars 30 and, as the second vehicle advances continuously, the track is lifted again by track lifting devices 26' so that sand planing and compacting device 35 may be slid under track ties 41 into its operating position on top of the protective sand layer. As the second vehicle continuously advances, the rotary brush of sweeping device 29 will sweep any sand deposited on ties 41 into the adjacent cribs and the resultant sand layer is continuously planed and condensed by planing shield 36 and compacting unit 37. Clean ballast may then be thrown onto planed and compacted protective sand layer 3 through opening 28'.

Figure 3:
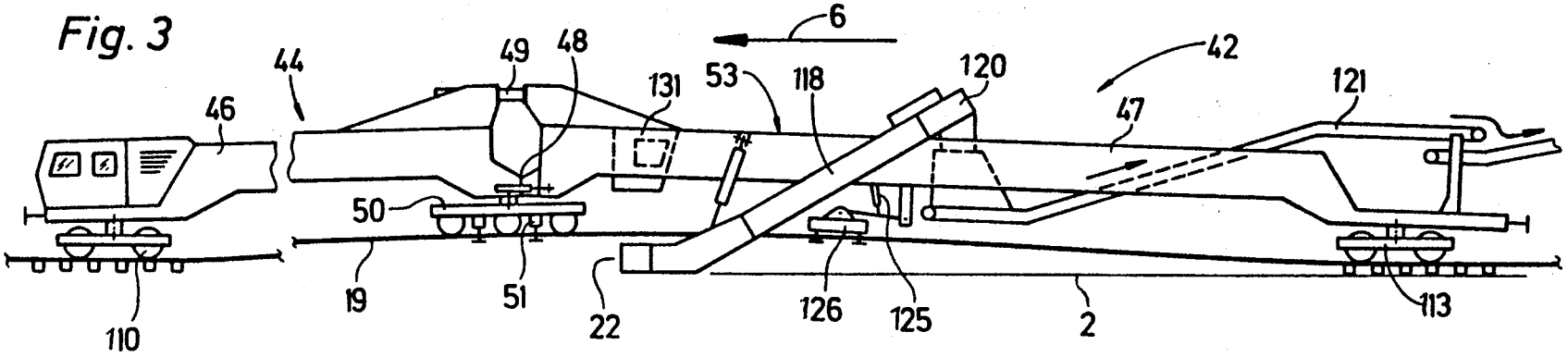
FIGS. 3 and 4 are like views of another embodiment.
Figure 4:
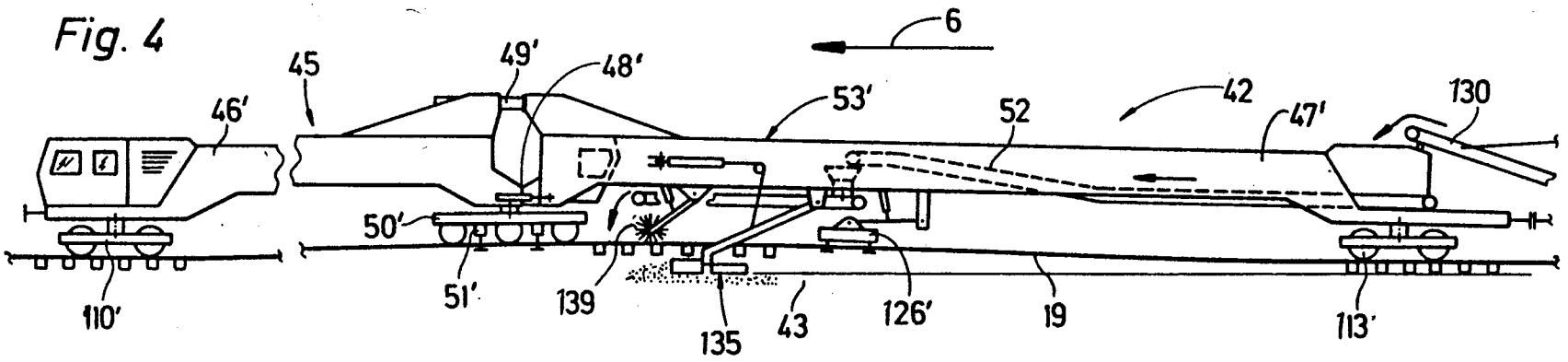

In most essential respects, track working machine arrangement 42 illustrated in FIGS. 3 and 4 resembles that of FIGS. 1 and 2, wherefore the description of these figures will be brief. Protective sand layer 43 is produced in substantially the same manner as layer 3 while track working machine arrangement 42 advances continuously in an operating direction indicated by arrows 6. First track working vehicle 44 is followed by consecutively arranged second track working vehicle 45, the vehicles comprising elongated two-part machine frame 53, 53' and the two parts 46, 47 and 46', 47' of each machine frame being linked by pivot 48 and 48' for pivoting of one part 47 and 47' in relation to the other part 46, 46' about a horizontal axis extending perpendicularly to the track. The two machine frame parts of machine frames 53 and 53' of vehicles 44 and 45 are connected by spindle drives 49 and 49' for changing the angular relationship between the two machine frame parts. Two undercarriages 110, 113 and 110', 113' support machine frames 53 and 53' on track 19. A third undercarriage 50 and 50' supports each machine frame in the range of pivot 48 and 48'. One of the track lifting devices 51 and 51' is mounted on the third undercarriage and ballast excavating device 118 and sand planing and compacting device 135 are mounted between track lifting devices 51, 51' and 126, 126'.

In contrast to the first-described embodiment, the track is lifted by the vertical adjustment drive 125 of track lifting devices 126 and 126' while spindle drives 49 and 49' are actuated to lift undercarriages 50 and 50' and thereby to lift track lifting devices 51, 51'. This lifting is accomplished by pivoting the two machine frame parts relative to each other about a horizontal axis extending perpendicularly to track 19 so that they are no longer horizontally aligned but enclose an angle with each other.

Excavated dirty ballast 22 is discharged from ballast excavating device 118 at station 120 onto elongated conveyor band 121 which removes the excavated ballast at the rear end of machine frame 47 to box cars following vehicle 44. Rear undercarriage 113 presses track 19 onto exposed subgrade 2. Consecutively arranged, second vehicle 45 again lifts the track off the exposed subgrade and elongated conveyor arrangement 52 continuously receives sand from conveyor 130 and delivers and discharges the sand onto the exposed subgrade ahead of sweeping device 139, whereupon the protective layer of sand 43 is planed and compacted by device 135. The track descends again, as in vehicle 47, so that it lies on the planed and compacted protective sand layer just before rear undercarriage 113' engages the track. Clean ballast may then be distributed on planed and compacted sand layer 43, and this ballast may be suitably tamped by a following tamper.

What we claim is:

1. A mobile track working machine arrangement mounted on a track for movement in an operating direction, the track comprising two rails fastened to ties supported on a subgrade by a bed of ballast, the machine arrangement comprising (a) two consecutively arranged, independent track working vehicles, each track working vehicle comprising (1) an elongated two-part machine frame, the two parts of the machine frame being linked by a pivot for pivoting of one part in relation to the other part about a horizontal axis extending perpendicularly to the track, and (2) undercarriages supporting the machine frame on the track, (b) a ballast excavating device vertically adjustably mounted on the machine frame of a first one of the track working vehicles for excavating the ballast supporting the track whereby the subgrade is exposed, (c) a conveyor arrangement mounted on the machine frame of the first track working vehicle for removing the excavated ballast, (d) a device for planing and compacting a protective layer of sand on the subgrade, the sand planing and compacting device being mounted on the machine frame of a second one of the track working vehicles, (e) a track lifting device mounted on each machine frame, each track lifting device comprising (1) lifting rollers rollingly engaging the track rails in permanent frictional contact therewith, and (f) a device for sweeping sand from the ties into adjacent cribs, the sweeping device being mounted on the machine frame of at least one of the vehicles.

2. The mobile track working machine arrangement of claim 1, wherein the ballast excavating device and the sweeping device are each mounted between two of said undercarriages, the undercarriages being mounted on the elongated machine frames for displacement in the direction of elongation of the machine frames, further comprising drives connected to the undercarriages for the displacement thereof.

3. The mobile track working machine arrangement of claim 2, wherein one of the displaceable undercarriages supporting the machine frames on the track immediately precedes the pivot in the operating direction for support of one of the machine frame parts, and further comprising another undercarriage non-displaceably connected to the one machine frame part for support of the one machine frame part remote from the pivot.

4. The mobile track working machine arrangement of claim 1, wherein two of said track lifting devices are mounted on each machine frame, the ballast excavating device and the sweeping device, respectively, being arranged on a respective one of the machine frames between the two track lifting devices.

5. The mobile track working machine arrangement of claim 1, wherein the sweeping device is vertically adjustably mounted on the machine frame and comprises a brush rotatable by a drive about an axis extending transversely to the machine frame elongation and parallel to the plane of the track, and a drive connecting the sweeping device to the machine frame for vertically adjusting the sweeping device.

6. The mobile track working machine arrangement of claim 5, wherein the sweeping device is mounted on the machine frame of the second vehicle immediately preceding the sand planing and compacting device, in the operating direction.

7. The mobile track working machine arrangement of claim 1, wherein the machine frame of the first vehicle defines an input opening for discharging sand on the exposed subgrade, the input opening immediately trailing the ballast excavating device, in the operating direction.

8. The mobile track working machine arrangement of claim 1, wherein the machine frame of the second vehicle defines an input opening for discharging ballast on the planed and compacted sand, the input opening trailing the sand planing and compacting device, in the operating direction.

9. The mobile track working machine arrangement of claim 1, wherein the conveyor arrangement comprises an elongated conveyor band extending forwardly from the ballast excavating device in the operating direction, the elongated conveyor band having an input end arranged to receive the excavated ballast from the ballast excavating device and a discharge end, a ballast storage silo arranged to receive the excavated ballast from the discharge end of the elongated conveyor band, and another conveyor band arranged at the bottom of the ballast storage silo for removing the stored ballast therefrom.

10. A method for rehabilitating a ballast bed supporting a track on a subgrade with a track working machine arrangement advancing continuously along the track, comprising the steps of (a) lifting the track and continuously excavating dirty ballast from under the lifted track to expose the subgrade, (b) discharging sand through the lifted track to lay a protective layer of sand on the subgrade, (c) lowering the track onto the protective layer of sand, and (d) lifting the track again and continuously planing and condensing the protective layer of sand.

* * * * *